United States Patent [19]

Rönbeck

[11] 4,368,882

[45] Jan. 18, 1983

[54] DEVICE FOR SEPARATING AN END BLANK FROM A STACK OF BLANKS

[75] Inventor: Arne I. Rönbeck, Olofström, Sweden

[73] Assignee: AB Volvo, Gothenburg, Sweden

[21] Appl. No.: 218,092

[22] Filed: Dec. 19, 1980

[30] Foreign Application Priority Data

Dec. 21, 1979 [SE] Sweden ..... 7910601

[51] Int. Cl.[3] ..... B65H 3/46

[52] U.S. Cl. ..... 271/135; 271/169

[58] Field of Search ..... 271/101, 104, 105, 37, 271/135, 131, 133, 134, 169

[56] References Cited

U.S. PATENT DOCUMENTS 2,789,481 4/1957 Palmer ..... 271/135 X

FOREIGN PATENT DOCUMENTS 504521 7/1930 Fed. Rep. of Germany ..... 271/135

1561418 3/1970 Fed. Rep. of Germany ..... 271/135

*Primary Examiner*—Richard A. Schacher

*Attorney, Agent, or Firm*—Young & Thompson

[57] ABSTRACT

A device for separating an end blank from a stack of blanks comprises a stacking rack and an arrangement including at least one drivable feeder tooth, at least two supports lying against the outer side of an end blank and at least one abutment. In said arrangement which can be coupled together with the rack, a support and a feeder tooth are located in close proximity, and at least one such set is located at opposite sides of an end blank in the stack. A fixed and a movable abutment is arranged at one side of the end blank in connection with the support and the feeder tooth. The support(s) opposite the abutments can be displaced perpendicularly to the plane of the blanks. The feeder teeth are arranged to move an end blank laterally in the stack.

5 Claims, 9 Drawing Figures

Figure 4:
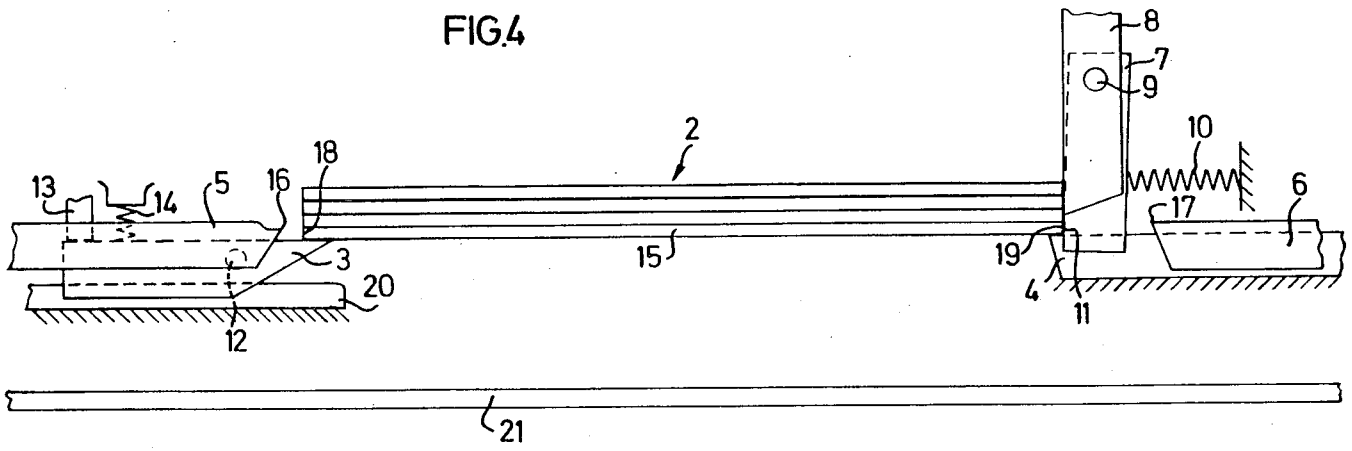

FIG.2
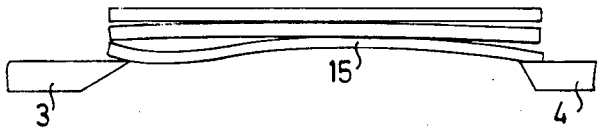
FIG.3
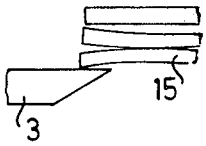
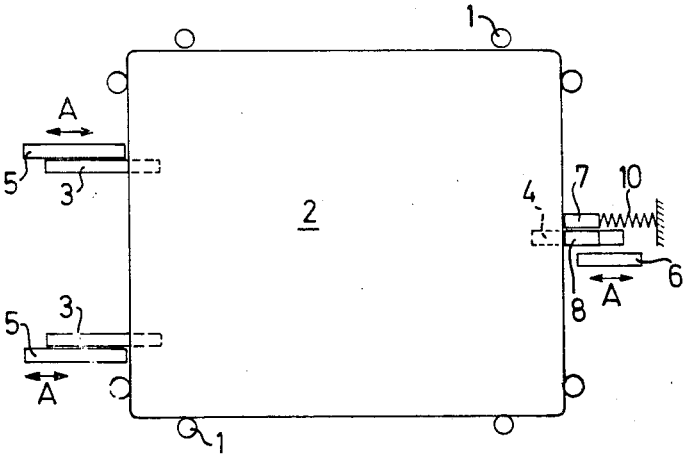
FIG.1

DEVICE FOR SEPARATING AN END BLANK FROM A STACK OF BLANKS

In various operations such as shearing, pressing, punching and bending, the starting material is essentially flat blanks which have been pretreated to the desired surface quality and dimension. Usually a magazine is used which is filled with blanks which are fed one at a time therefrom. They are then subjected in a suitable machine or machine line to one or more operations, to make it either into a finished product or an intermediate product which is then subjected to further operations, usually in another machine or machine line.

When feeding a blank out from such a magazine, it is important that only one blank at a time be fed out and that the feeding-out of the blank always be reliable for steady feeding to the machine or machine line in question. Even if the blanks should for example stick to each other due to flatness, e.g. sheets of glass or by oiling of sheet blanks for example, be warped, dented or have edge burrs, it should be possible to separate one blank at a time from the stack.

Such a device should also make it possible to separate one blank from a stack where the blanks are stacked horizontally on each other, or from a stack where the blanks are stacked vertically next to each other. Known gripping and/or feeding devices can then convey and feed the end blank from the stack to the desired machine or machine line. Such devices can for example comprise suction cup arrangements.

A device according to the invention ensures an even supply of only one blank at a time to the desired processing machine.

Thus according to the invention a device is intended for separating an end blank from a stack of blanks, for example a stack of sheet metal blanks, regardless of blank warping, adhesion between blanks or shearing burrs, said device comprising firstly a stacking rack, secondly an arrangement which can be coupled together or built together with the rack, said arrangement containing at least one drivable feeder tooth, at least two supports arranged to lie against the outer side of an end blank and at least one abutment, said device being characterized in that in the arrangement which can be coupled together or built together with the rack, a support and a feeder tooth are located in close proximity, and in that at least one such set, i.e. support and feeder tooth, is located at opposite sides of an end blank in the stack, a fixed and a movable abutment being arranged at one side of the end blank in connection with the support and the feeder tooth, the support(s) opposite the abutments being displaceable in a direction perpendicular to the plane of the blanks, and in that the feeder teeth are arranged to move an end blank laterally in the stack.

The device according to the invention is characterized in that between the end of the fixed abutment and the upper surface of the adjacent support, in a direction perpendicular to the plane of the blanks in the stack, there is a gap which is larger than the blank thickness but less than twice the blank thickness.

The invention is further characterized in that the feeder tooth (teeth) arranged at each opposite side of an end blank in the stack is (are) alternatively reciprocally drivable.

The feeder teeth which act against the edges of an end blank are, according to the invention, made with a point or edge by virtue of the fact that, as viewed in section from the side, they are bevelled both on the underside and on the top side or, in addition to the bevelling on the underside or top side, respectively, they are provided with a step which is intended from the point or edge in relation to the top or undersurface, respectively, of the tooth, the transition of the step to the top surface or undersurface, respectively, being bevelled.

The supports in the device according to the invention are bevelled on their top sides or undersides, respectively, so that when viewed in section from the side they are pointed.

According to one embodiment of the invention the feeder teeth on either side of the stack are driven separately, and according to another embodiment they are driven by a common drive means.

Figure 5:
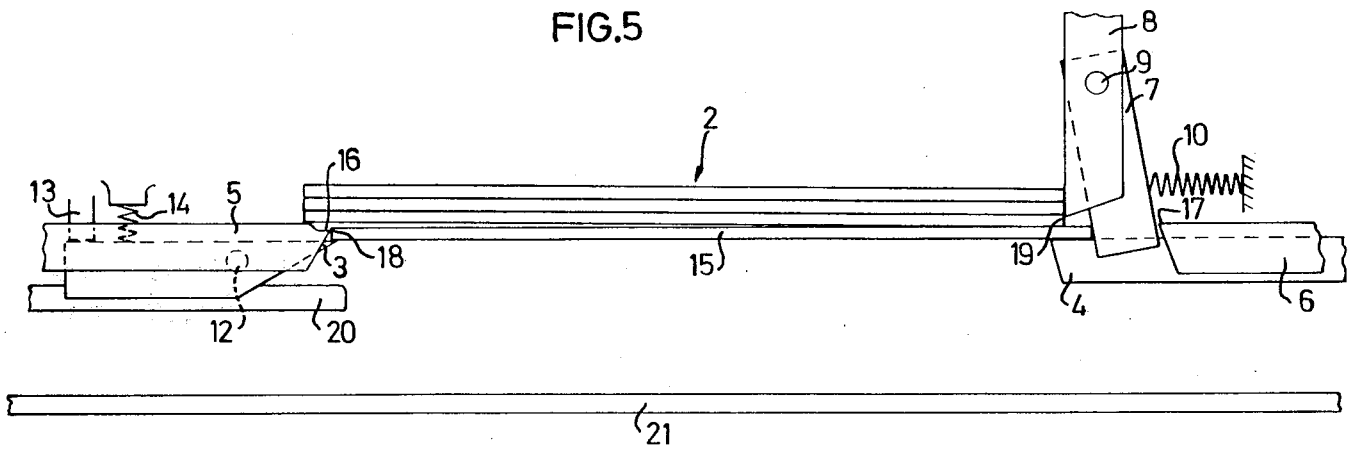
Figure 6:
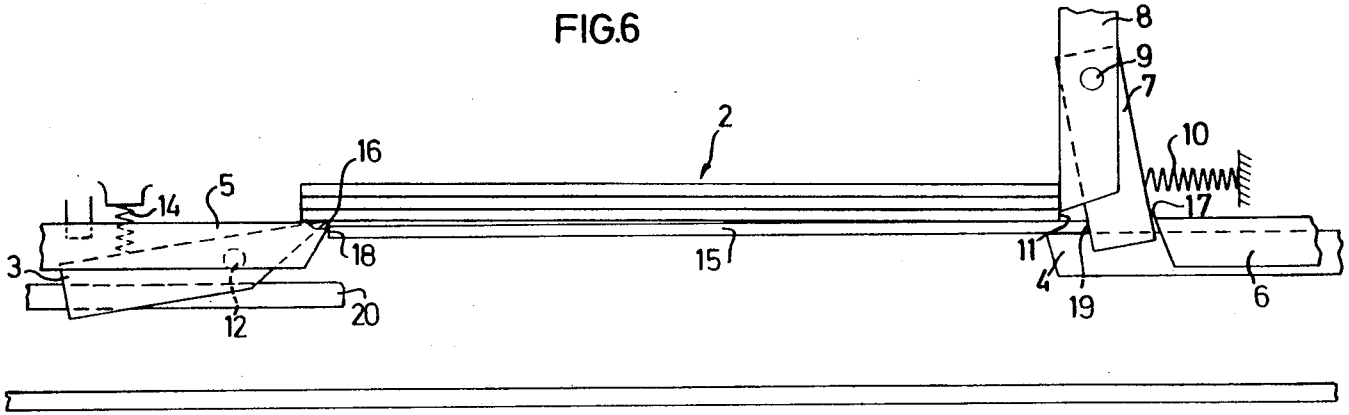
Figure 7:
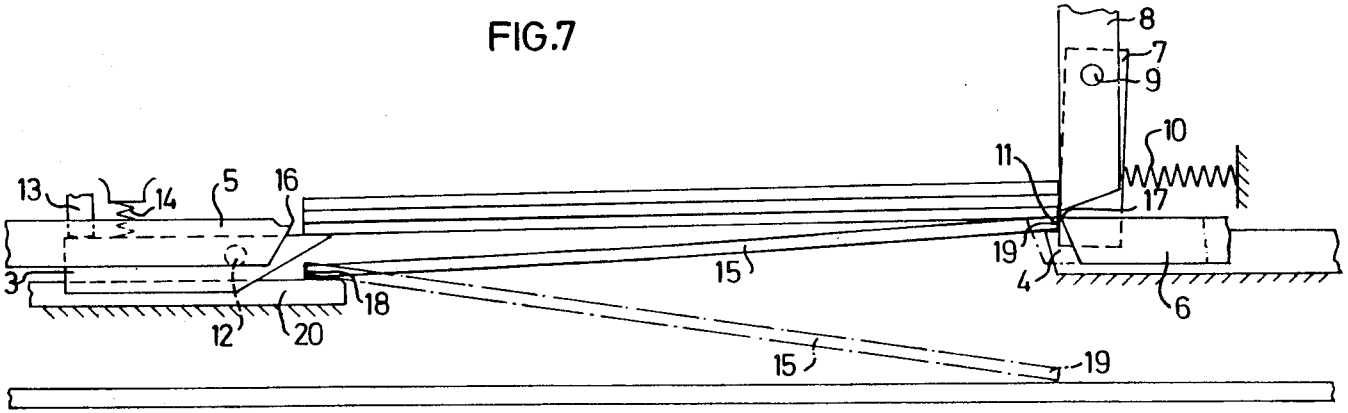
Figure 8:
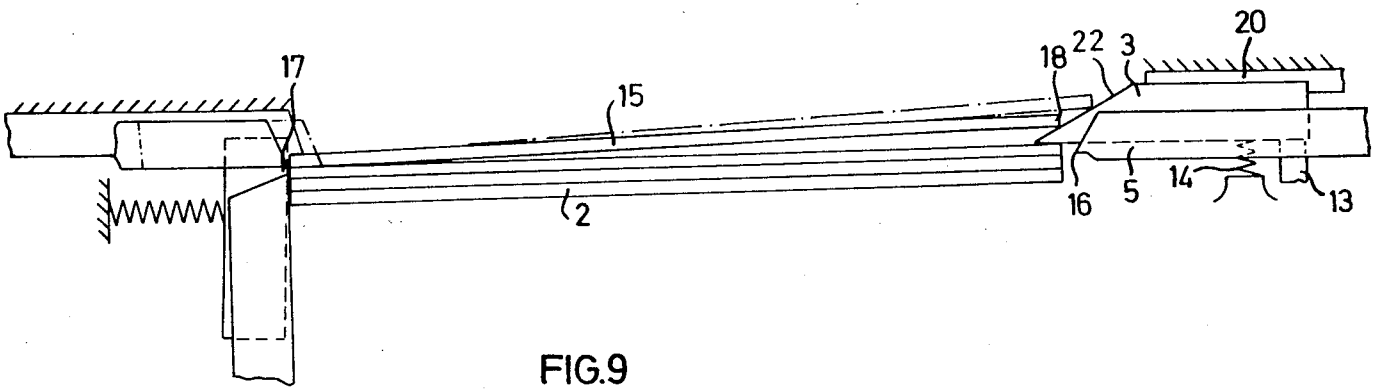
Figure 9:
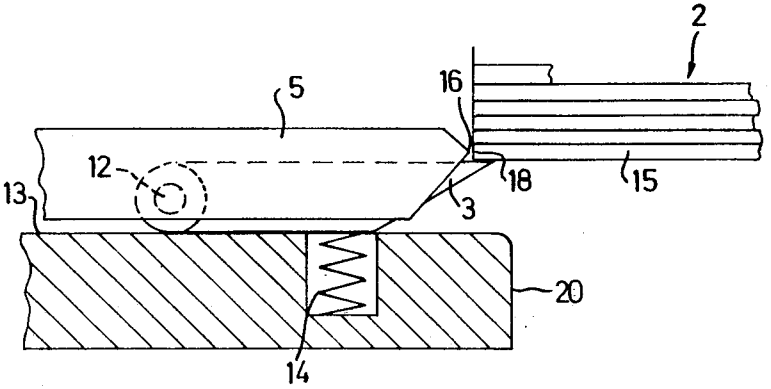

Two embodiments of the invention will be described below in more detail in connection with the accompanying schematic drawings, in which:

FIG. 1 shows a device according to the invention as seen from above,

FIGS. 2 and 3 show the stacking of non-planar blanks on supports in the device according to the invention, FIGS. 4–7 show examples of the various steps in the separation of an end blank from the bottom of a vertical stack of blanks, or alternatively, with the figures turned upside down, the separation of an end blank from the top of the vertical stack of blanks, FIG. 8 shows another embodiment of FIG. 7 shown upside down, i.e. the final step in a separation of a blank from the top of a stack of blanks, and FIG. 9 shows an alternative embodiment for a feeder tooth and support on the side of the stack which is opposite to the abutments.

In FIG. 1, which shows schematically a device according to the invention as viewed from above, 1 designates a rack which can be adjustable in relation to the size of the blank and which holds a stack 2 of blanks. The adjustment means for the rack are not shown. Cooperating with the rack 1, there are on opposite sides of the stack 2 supports 3 and 4, feeder teeth 5 and 6, abutments 7 and 8 and drive means (not shown) for the feeder teeth. The supports 3,4, the teeth 5,6 and the abutments 7,8 can either be built together into a unit, for example a frame which can easily be coupled to the rack 1, or be a part of the rack 1.

FIG. 1 shows altogether three supports 3 and 4, but according to the invention it is quite sufficient to have the support 3 together with and suitably directly opposite to the support 4.

FIGS. 2 and 3 show how the supports 3 and 4 carry, or are in contact with, as the case may be, an end blank in a stack of dented or warped blanks.

FIGS. 4–7 show the parts of the device in more detail, and the functioning of the device will be described. It is true that these figures show completely flat blanks, but the embodiment also applies to dented or warped blanks, since according to the invention the support 3 and the feeder tooth 5 are arranged close beside each other. The same is true of the support 4 and the feeder tooth 6. Of the abutments 7 and 8, the abutment 8 is fixed as a blocking means for the blanks 2 in the stack, and the abutment 7 is pivotable about a shaft 9 against a spring 10. Between the lower end of the fixed abutment 8 and the upper surface of the support 4 there is a gap 11, the height of which is greater than the thickness of the blank but less than twice said thickness. The support 4 is, as indicated in the figure, fixed and non-movable.

The feeder tooth 6 is drivable with a reciprocable movement.

The support 3 is however in this embodiment movably mounted on a shaft 12 and is limited in its movement by a fixed stop 13. A spring 14 urges the rear portion of the support, as seen in FIGS. 4–7, downwards; its forward portion resting against the end blank 15 upwards. The weight of the stack or the contact pressure of the support against the end blank urges the rear portion of the support 3 against the fixed stop, against the pressure of the spring 14.

The feeder tooth 5 is also drivable with a reciprocable movement, as indicated by the arrows A in FIG. 1. The feeder teeth 5 and 6 are provided with a point or edge 16 and 17, respectively, and these points are located at a distance above the upper surfaces of the supports 3 and 4, respectively, of 0.6–0.7 times the thickness of the blank, to assure that the point of edge 16 or 17, respectively, of the tooth will achieve a satisfactory grip in the edge of the blank when the tooth is moved laterally in the stack.

In order to separate the end blank 15 from the stack 2, the feeder tooth 5 is moved to the right, as seen in FIG. 4. Its point 16 will then come into contact with the edge surface 18 of the end blank 15 and move the end blank 15 laterally in the stack 2. The opposite edge 19 of the end blank 15 will thus move the abutment 7 against the pressure of the spring 10 and enter the gap 11 between the bottom portion of the fixed abutment 8 and the upper surface of the support 4. According to the invention the height of the gap 11 should be greater than the blank thickness but less than twice said thickness. The fixed abutment 8 will thereby prevent the rest of the blanks, and especially those lying adjacent to the end blank 15, from also being moved laterally.

The various parts of the device now assume the position shown in FIG. 5. The end blank 15 is just about to be pushed from the support 3. At the same time the feeder tooth 5, by virtue of its step-bevelled shape on the top behind the point 16, has lifted the stack 2 so that a very narrow slot between the end blank 15 and the next blank can be seen.

It can be seen from FIG. 6 that the feeder tooth 5 has pushed the end blank 15 from the support 3 which, due to the action of the spring 14, has been turned about its shaft 12 and come into contact with the next blank in the stack. To the right in FIG. 6 the abutment 7 has been moved further to the right and tensioned the spring 10 further.

In the next moment, when the feeder tooth 5 starts to move back (to the left in the figure) to the starting position in FIG. 4, the edge 18 of the end blank falls down at the same time as the end blank 15 is pushed back to the left by the spring 10 of the abutment 7, but not farther than that the abutment 7 comes into contact with the rest of the blanks in the stack 2. Thus the end blank 15 will lie with its edge 18 for example on a support 20 which in turn carries the blank support 3. The other end of the blank rests on the support 4. This position is illustrated with solid lines for the end blank 15 and the feeder tooth 6 in FIG. 7.

The feeder tooth 6 is now moved to the left (as seen in FIG. 7) thus pushing the edge of the blank 15 over the edge of the support 4 allowing the next blank in the stack to rest on the support 4. The former end blank 15 is illustrated with dash-dot lines, as is the position of the feeder tooth 6. The feeder tooth 6 then returns to the starting position according to FIG. 4, and the blank 15 separated from the stack 2 is now taken care of by a suitable conveyor device such as a conveyor belt 21 or some sort of gripping device, and the sequence is repeated.

In the preceding, a device for separating the bottom blank from a stack of blanks has been described. As has been mentioned, according to the invention the uppermost blank in a stack of blanks can be separated from the stack in a similar manner. This can be easily seen by viewing FIGS. 4–7 upside down, and FIG. 8, corresponding to FIG. 4, illustrates the procedure. Note that the support 20 does not extend as far forward and that there is no conveyor belt 21.

In order to separate the top blank in a stack, regardless of warping, sticking together of blanks and possible shear burrs, one proceeds in the same manner as is described in connection with FIGS. 4–7. The difference here is that the supports 3 and 4 do not support the stack but only are in contact with the top blank. The functioning of the feeder teeth 5 and 6 is the same as before.

Instead of falling down as shown in FIG. 7, the blank 15 in FIG. 8, which is to be separated from the stack, is pushed in the next to the last step up onto the inclined surface 22 of the support 3 and is separated from the underlying next blank by means of the feeder tooth 6 which in FIG. 8 frees the uppermost blank 15 from the support 4 by pushing the blank 15 to the right in FIG. 8, thus pushing the blank up the inclined surface 22 of the support 3 (dash-dot lines for blank 15 and feeder tooth 6). The support 4 then comes into contact with the next blank in the stack 2, as the support 3 has already done.

FIG. 9 shows a preferred embodiment of a feeder tooth 5. The point or edge 16 covers an angle of almost 90° between the upper and lower surfaces of the point. This design is preferable since the point, which should be made of a hard material such as high-speed steel or cemented carbide, will then be simpler to manufacture. In contrast to FIGS. 4–7 the support 3 in FIG. 9 has its fulcrum at its rear end instead of at its front end.

The spring-mounted abutment 7 can be made as a fork (not shown) around the abutment 8, which is always fixed.

The device according to the invention causes an end blank in a stack of blanks to perform a zigzag movement: in the example shown according to FIGS. 4–7 first to the right, then to the left, so that in the interaction between the movable support 3, the feeder teeth 5,6, the abutment 8 and the abutment 7 movable against the spring 10, one blank at a time can be separated from the stack so that a suitable device can grip and convey it to the desired station.

It is also possible to use the invention on a stack of blanks in which the blanks stand on edge, to assure that only one blank at a time is separated from the stack.

The blanks which can be handled by the invention can be square, rectangular or round, thick or thin, because according to another embodiment of the invention the device is completely adjustable so that varying dimensions can be handled.

What I claim is:

1. A device for separating an end blank from a stack of blanks, comprising a stacking rack having at least two drivable feeder teeth, at least two supports arranged to lie against the outer side of an end blank, a said support and feeder tooth being located in close proximity to each other at each of two opposite sides of an end blank in the stack, a fixed abutment at one of said two sides of the end blank, a said support opposite the abutment being displaceable in a direction perpendicular to the plane of the blanks, the feeder teeth being adapted to move an end blank laterally in the stack.

2. A device as claimed in claim 1, in which between the end of the abutment and the upper surface of the adjacent support, in a direction perpendicular to the plane of the blanks in the stack, there is a gap which is larger than the blank thickness but less than twice the blank thickness.

3. A device as claimed in claim 1, in which the feeder teeth are alternatingly reciprocally drivable.

4. A device as claimed in claim 3, in which the ends of the feeder teeth, acting on the edges of the blank, are made with an edge by being, as viewed in section from the side, bevelled both on the underside and on the upper side.

5. A device as claimed in claim 1, in which the supports are bevelled on their upper or lower sides, so that when viewed in section from the side they are pointed.

* * * * *